US006642910B2

(12) United States Patent
Takada et al.

(10) Patent No.: US 6,642,910 B2
(45) Date of Patent: Nov. 4, 2003

(54) PLASMA DISPLAY DEVICE

(75) Inventors: Hidekazu Takada, Tokyo (JP); Mitsuo Ueoka, Tokyo (JP)

(73) Assignee: NEC Corporation, Tokyo (JP)

( * ) Notice: Subject to any disclaimer, the term of this patent is extended or adjusted under 35 U.S.C. 154(b) by 94 days.

(21) Appl. No.: 09/835,572

(22) Filed: Apr. 17, 2001

(65) Prior Publication Data

US 2001/0030513 A1 Oct. 18, 2001

(30) Foreign Application Priority Data

Apr. 18, 2000 (JP) ..... 2000-116643

(51) Int. Cl.[7] ..... G09G 3/28
(52) U.S. Cl. ..... 345/60; 345/63
(58) Field of Search ..... 345/60, 63, 102, 345/204, 207, 211, 212, 213, 214; 713/321, 322, 300, 320; 315/169.4

(56) References Cited

U.S. PATENT DOCUMENTS

| | | | | | |
|---|---|---|---|---|---|
| 5,396,443 | A | * | 3/1995 | Mese et al. | 713/322 |
| 5,475,847 | A | * | 12/1995 | Ikeda | 713/321 |
| 5,621,437 | A | * | 4/1997 | Jeong | 345/173 |
| 5,808,693 | A | * | 9/1998 | Yamashita et al. | 345/211 |
| 6,005,559 | A | * | 12/1999 | Miyamoto | 345/212 |
| 6,144,359 | A | * | 11/2000 | Grave | 345/102 |
| 6,249,270 | B1 | * | 6/2001 | Ito | 345/211 |

* cited by examiner

*Primary Examiner*—Xiao Wu
(74) *Attorney, Agent, or Firm*—Sughrue Mion, PLLC

(57) ABSTRACT

A plasma display device is provided with a plasma display panel and a luminance controller. The luminance controller lowers a luminance on the plasma display panel when there is no change in an input signal for a predetermined position in the plasma display panel within a predetermined time than a luminance when there is a change in the input signal within the predetermined time.

9 Claims, 3 Drawing Sheets

PLASMA DISPLAY DEVICE

BACKGROUND OF THE INVENTION

1. Field of the Invention

The present invention relates to a plasma display device employed in a flat-panel television, an information displaying device, and the like, and more particularly to a plasma display device which suppresses image sticking caused by light emission at high luminance.

2. Description of the Related Art

In case of a display device such as a plasma display device, displaying an image over a long period causes image sticking due to deterioration of phosphor or the like. In particular, the plasma display device performs displaying by means of photoluminescence of the phosphor that uses vacuum UV rays generated by the discharge. For this reason, deterioration occurs on the surface of the electrode by the discharge, and in the phosphor by ion bombardment and exposure to vacuum UV rays. The deterioration on the surface of the electrode and in the phosphor depends on the number of discharges. In other words, the higher the luminance, that is, the greater the number of discharges per unit time, the faster the phosphor deteriorates, and illuminating the phosphor partially at high luminance causes a difference in luminance from the surrounding portion, which causes image sticking to occur in a short time.

FIG. 1 is a block diagram showing a major portion of a conventional plasma display device. FIG. 2 is a graph showing a relation of load of display versus luminance in the conventional plasma display device.

As shown in FIG. 1, the conventional plasma display device is provided with a control circuit 12, which controls luminance on a plasma display panel (PDP) 11 in response to load (a quantity of load) read on an input signal. The control circuit 12 controls the luminance in a manner as shown in FIG. 2. More specifically, the control circuit 12 lowers the luminance as the load of display increases, and heightens the luminance as the load of display decreases.

The conventional plasma display device adopts such a control method that it can display a sharp motion picture. Consequently, in case of a scene having a partial highlight region, such as a scene of the sunrise or metal reflecting sunlight, the luminance in the partial highlight region is heightened further to be emphasized, so that such a scene can be displayed sharply. On the other hand, there can be offered an effect that power consumption is saved when displaying a scene that glows across the screen.

However, when the foregoing conventional plasma display device is chiefly used to display fixed characters like a display board, as has been discussed, luminance is high and therefore the number of discharges increases at a partial highlight region, for example, a character portion displayed in white on the black background. Thus, luminance-induced deterioration occurs at different speeds in the white character portion and the black background portion, in other words, the white character portion deteriorates faster than the black background portion. Hence, when a different image, in particular, a monochrome image in white is displayed on the entire screen, a problem occurs that the portion used in displaying the white characters becomes darker than the rest, which is often recognized as image sticking. In case that the display area is small and load is low, in particular, the luminance at the display portion reaches its maximum, which accelerates the deterioration in the phosphor, thereby raising a problem that the image sticking occurs in a short time. In an extreme case, image sticking is observed within several tens of hours when a fixed pattern is kept displayed in a small display area.

On the other hand, if the luminance is limited in order to suppress the occurrence of the image sticking and extend the service life thereof, the luminance and contrast decrease in all the display patterns over the entire display period. This causes a problem that both the display quality and visibility deteriorate.

SUMMARY OF THE INVENTION

It is an object of the present invention to provide a plasma display device capable of suppressing the occurrence of image sticking while maintaining a high display quality and satisfactory visibility.

A plasma display device according to the present invention comprises a plasma display panel and a luminance controller. The luminance controller lowers a luminance on the plasma display panel when there is no change in an input signal for a predetermined position in the plasma display panel within a predetermined time than a luminance when there is a change in the input signal within the predetermined time.

In the present invention, because the luminance controller controls the luminance in relation to whether there is a change in an input signal within a predetermined time, adequate luminance can be set separately when displaying a still image, which neither has a change in an input signal nor requires high luminance, and when displaying dynamic images, which require high luminance. Accordingly, it is possible to maintain a sharp image quality when displaying dynamic images, while suppressing the occurrence of image sticking by controlling the luminance when displaying a still image.

Also, by setting the luminance to a constant level when there is no change in the input signal regardless of the load, the image sticking on the plasma display panel can be suppressed in a reliable degree. If it is designed so as to lower the luminance as the load increases when there is no change in the input signal, a change in luminance between when there is a change in the input signal and when there is no change in the input signal becomes smaller, thereby improving the visibility compared with when the luminance is set to a constant level. Further, if a plurality of luminance levels when there is no change in the input signal are provided relating with time lengths during which there is no change in the input signal, the luminance may be further lowered when there is no change in the input signal over a longer period of time, thereby making it possible to suppress the occurrence of the image sticking further.

Also, by locating the predetermined position at one of four corners of the plasma display panel, the device may be suitably used in chiefly displaying fixed characters, such as diagrams which change the screen almost entirely, charts, and text information.

Further, in case that the input signal is a signal in which a predetermined format varies, the predetermined position may be set to a position determined arbitrary in the plasma display panel. Accordingly, the device is suitably used as an information board in public facilities, timetables for train, airlines and the like.

DETAILED DESCRIPTION OF THE PREFERRED EMBODIMENT

Figure 1:
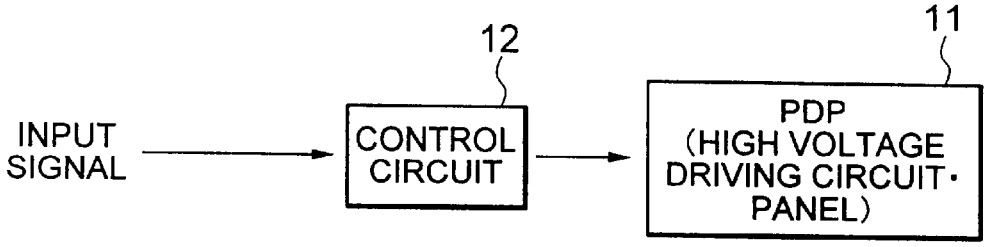
FIG. 1 (PRIOR ART)
FIG. 1 is a block diagram showing a major portion of a conventional plasma display device.
Figure 2:
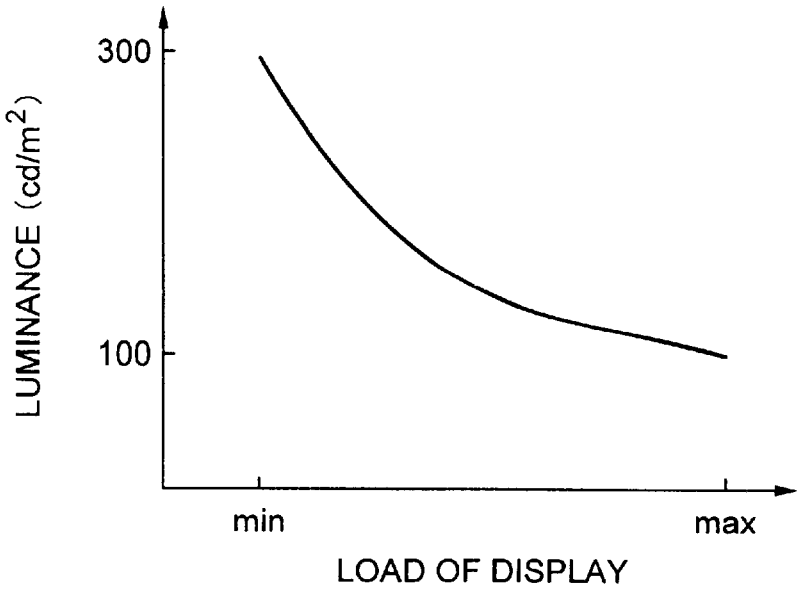
FIG. 2 (PRIOR ART)
FIG. 2 is a graph showing a relation of load versus luminance in the conventional plasma display device.
Figure 3:
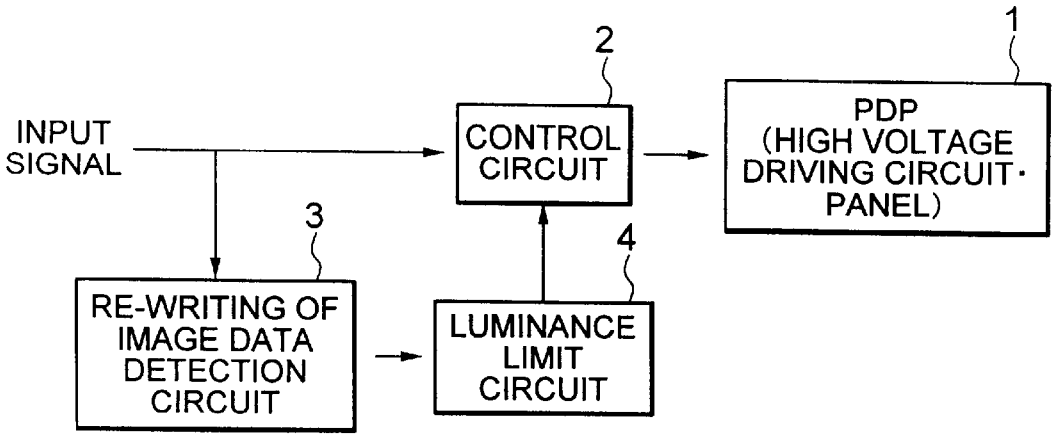
FIG. 3 is a block diagram showing a major portion of a plasma display device in accordance with a first embodiment of the present invention.

Hereinafter, embodiments of the present invention will be described in detail with reference to the accompanying drawings. FIG. 3 is a block diagram showing a major portion of a plasma display device in accordance with a first embodiment of the present invention.

The plasma display device in accordance with the first embodiment is provided with a control circuit 2, which controls luminance on a plasma display panel (PDP) 1 in response to load of display (a quantity of load) read on an input signal. Also, the plasma display device is provided with a re-writing of image data detection circuit 3, which detects whether image data in the form of an input signal into a predetermined position in the PDP 1 is re-written within a predetermined time. Further, the plasma display device is provided with a luminance limit circuit 4, which issues a command to the control circuit 2 to shift from high luminance display (first mode), which is suitable in displaying dynamic images, to low luminance display (second mode), which is suitable in displaying fixed characters, upon judging the data has not been re-written over a certain period of time based on an output signal from the re-writing of image data detection circuit 3. Here, the PDP 1 includes a high voltage driving circuit and a panel. Also, the control circuit 2 is provided with load-to-luminance control lookup tables used in switching the display modes of luminance based on the command from the luminance limit circuit 4.

Figure 4:
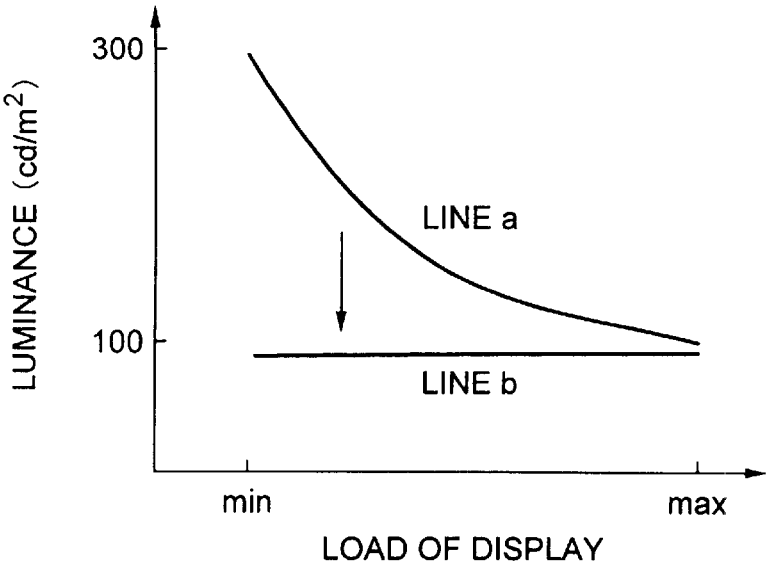
FIG. 4 is a graph showing a relation of load versus luminance in the plasma display device in accordance with the first embodiment of the present invention.

Next, the following description will describe an operation of the plasma display device in accordance with the first embodiment arranged as discussed above. FIG. 4 is a graph showing a relation of load versus luminance in the plasma display device in accordance with the first embodiment of the present invention.

In the present embodiment, an input signal is branched and sent to both the control circuit 2 and re-writing of image data detection circuit 3.

Upon detection of a change in the input signal, the re-writing of image data detection circuit 3 outputs a signal indicating this to the luminance limit circuit 4. Upon receipt of the signal, the luminance limit circuit 4 issues a command to the control circuit 2 to effect the high luminance display (first mode). Then, the control circuit 2 controls the luminance in a manner indicated by a line a in FIG. 4 with reference to the load-to-luminance control lookup table. In other words, the control circuit 2 lowers the luminance when the load of display is high, and heightens the luminance when the load of display is low.

Under the luminance control indicated by the line a, luminance varies with load, and the lower the load, the higher the luminance becomes. For example, the luminance is lowered to 100 cd/m$^2$ at the maximum of the load (max), whereas the luminance is heightened to 300 cd/m$^2$ at the minimum of the load (min). The luminance varies in a curve and takes a value between 100 cd/m$^2$ and 300 cd/m$^2$ when the load is somewhere between the min and max. For this reason, in case that the re-writing of image data detection circuit 3 detects a change in the input signal, higher luminance is achieved when the load is low, that is, when a small area is highlighted partially, compared with when the load is high, that is, when a large area is highlighted.

In case of displaying dynamic images, with which an input signal keeps changing continuously within a certain period of time, the control circuit 2 maintains the high luminance display (first mode) indicated by the line a. This makes it possible to achieve a display suitable in displaying dynamic images, in which the luminance at a partial highlight region is emphasized.

On the other hand, after the display mode is set to the high luminance display (first mode), when the re-writing of image data detection circuit 3 detects no change in the input signal over a certain period of time (for example, a few minutes), the re-writing of image data detection circuit 3 outputs a signal indicating this to the luminance limit circuit 4. Upon receipt of the signal, the luminance limit circuit 4 issues a command to the control circuit 2 to effect the low luminance display (second mode). Accordingly, the control circuit 2 switches the load-to-luminance control lookup tables, and controls the luminance in a manner indicated by a line b in FIG. 4. In other words, luminance is set to a constant value in the low luminance, for example, 100 cd/m$^2$, regardless of whether the load of display is high or low.

Under the luminance control indicated by the line b, display is always performed at the constant low value in the luminance regardless of the load. In short, load-dependent emphasis on the luminance is not executed.

When the re-writing of image data detection circuit 3 detects a change in the input signal again as the operation continues, the control circuit 2 controls the luminance in the manner indicated by the line a by repeating the actions discussed above.

The plasma display device according to the first embodiment repeats the foregoing actions. In other words, the display modes are shifted between the case of displaying dynamic images, with which an input signal changes continuously, and the case of displaying a fixed pattern chiefly.

As has been discussed, according to the first embodiment, in case that the fixed characters are displayed, the re-writing of image data detection circuit 3 judges that the device is used chiefly to display the fixed characters, whereupon the load-to-luminance control lookup table is switched automatically and the display mode is shifted to the low luminance display (second mode, that is, fixed character display mode). Consequently, it is possible to suppress the occurrence of the image sticking by controlling the average light emission luminance and contrast while reducing influence on visibility. On the other hand, in case that dynamic images are displayed, the re-writing of image data detection circuit 3 judges this, and switches the display method to the one such that emphasizes the luminance and contrast partially. For this reason, not only can sharp dynamic images be displayed without impairing the display quality of the same, but also the occurrence of the image sticking can be suppressed when the fixed characters are displayed.

As to the detection position in the PDP 1 where the re-writing of image data detection circuit 3 detects a change in the input signal, in case that the device is chiefly used to display the fixed characters, for example, when diagrams, charts, and text information that change the screen almost entirely are displayed as the fixed characters at a conference room or the like, four corners of the display screen may be used as the detection positions, for example. In this case, an input signal at each detection position is sampled, and whether there is a change in the input signal is detected, whereby the fixed character display may be distinguished from the dynamic images display. In addition, when the device is used where a predetermined display format changes, such as an information board in public facilities, timetable for trains or airlines, etc., a predetermined portion may be sampled. For example, as was discussed above, the sampling may be conducted such that the display modes can be distinguished with the least number of samples on the display screen, and the samples can be of any shape including a grid, a line, a rectangle, a circle or the like.

Figure 5:
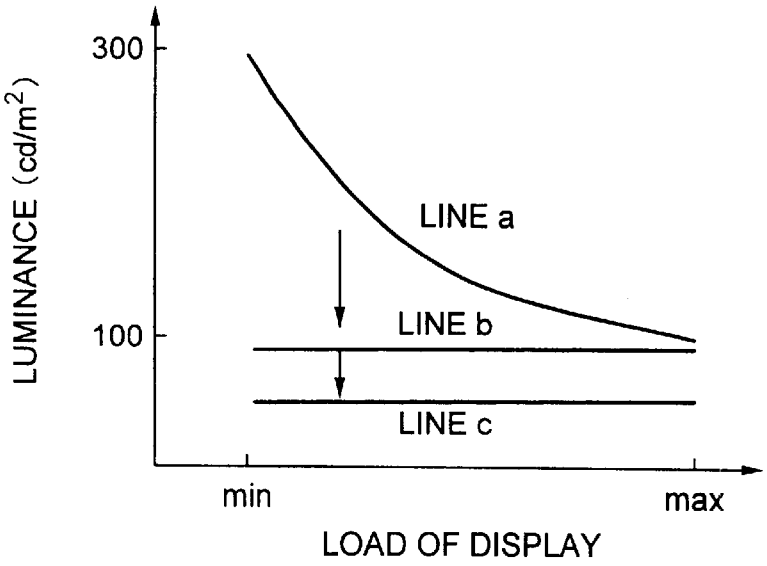
FIG. 5 is a graph showing a relation of load versus luminance in a plasma display device in accordance with a second embodiment of the present invention.

Next, the following description will describe a second embodiment of the present invention. In the second embodiment, the control circuit 2 controls the luminance in a different manner from that in the first embodiment. FIG. 5 is a graph showing a relation of load versus luminance in a plasma display device in accordance with the second embodiment.

In the second embodiment, luminance indicated by a line c, which is lower than the line b shown in FIG. 4, is additionally provided as a level of the low luminance display, to which the display mode is shifted when no change is detected in the input signal.

In the second embodiment, like in the first embodiment, in case that no change is detected in the input signal over a certain period of time (for example, a few minutes) after dynamic images were displayed, the control circuit 2 switches the load-to-luminance control lookup table from the line a to the line b for the low luminance display. Further, when the re-writing of image data detection circuit 3 detects no change over a longer period of time (for example, several tens of minutes to one hour or so) from the switching, the luminance limit circuit 4 issues a command to the control circuit 2 to effect the control at the lower luminance, whereby the control circuit 2 starts to control the luminance with reference to the line c.

The second embodiment discussed above is suitable for use as an information board in public facilities, such as timetables at airports or train stations. When used for these purposes, the display pattern is substantially the same, and a change occurs usually in an extremely small portion. Therefore, in order to prevent the occurrence of image sticking, the luminance has to be lowered as much as possible. Under these conditions, according to the second embodiment, the luminance can be set lower than the first embodiment, and therefore, the occurrence of the image sticking can be prevented further.

Figure 6:
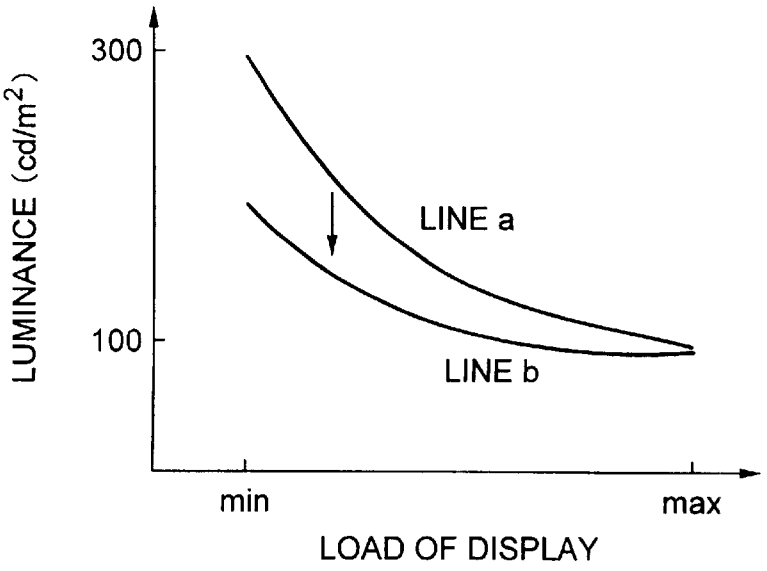
FIG. 6 is a graph showing a relation of load versus luminance in a plasma display device in accordance with a third embodiment of the present invention.

Next, the following description will describe a third embodiment of the present invention. In the third embodiment, the control circuit 2 controls the luminance in a different manner from those in the first and second embodiments. FIG. 6 is a graph showing a relation of load versus luminance in a plasma display device in accordance with the third embodiment of the present invention.

In the first and second embodiments, a constant level is set regardless of the load of display for the low luminance display, to which the display mode is shifted when no change is detected in the input signal. On the other hand, in the third embodiment, it is designed such that luminance varies in response to load of display also in the low luminance display, so that luminance will be heightened slightly at low load.

According to the third embodiment described above, better visibility can be attained compared with the first embodiment while preventing the occurrence of the image sticking. In the first embodiment, in case that the display area is small and the load is low, the luminance may drop abruptly when the control with reference to the line a shifts to the control with reference to the line b, which may result in lower visibility. In contrast, according to the third embodiment, a drop in the luminance at the low load is smaller than that in the first embodiment, thereby improving the visibility. The third embodiment is suitable, for example, for use at a conference room, that is, no change is detected in the input signal over a relatively short period of time (for example, a few minutes).

What is claimed is:

1. A plasma display device, comprising:

a plasma display panel; and a luminance controller which lowers the luminance on said plasma display panel when there is no change in an input signal for a predetermined position in said plasma display panel within a predetermined time below a luminance when there is a change in said input signal within said predetermined time, wherein said luminance controller includes:

a detection circuit which detects whether said input signal changes within said predetermined time; and a control circuit which switches a luminance on said plasma display panel by selecting one of a plurality of tables, each showing a predetermined relation of load versus luminance, based on a result of detection by said detection circuit.

2. The plasma display device according to claim 1, wherein in case that there is no change in said input signal, a luminance on said plasma display panel is constant regardless of load.

3. The plasma display device according to claim 1, wherein in case that there is no change in said input signal, a luminance on said plasma display panel is lowered as load increases.

4. The plasma display device according to claim 1, wherein a plurality of luminance levels when there is no change in said input signal are provided relating with time lengths during which there is no change in said input signal.

5. The plasma display device according to claim 2, wherein a plurality of luminance levels when there is no change in said input signal are provided relating with time lengths during which there is no change in said input signal.

6. The plasma display device according to claim 3, wherein a plurality of luminance levels when there is no change in said input signal are provided relating with time lengths during which there is no change in said input signal.

7. The plasma display device according to claim 1, wherein said predetermined position is located at one of four corners of said plasma display panel.

8. The plasma display device according to claim 1, wherein said input signal is a signal in which a predetermined format varies.

9. A plasma display device, comprising:

a plasma display panel; and a luminance controller which lowers the luminance on said plasma display panel when there is no change in an input signal for a predetermined position in said plasma display panel within a predetermined time below a luminance when there is a change in said input signal within said predetermined time, wherein said predetermined position is located at one of four corners of said plasma display panel.

* * * * *